US005246017A

United States Patent [19]

Saintsing et al.

[11] Patent Number: 5,246,017

[45] Date of Patent: Sep. 21, 1993

[54] CIGARETTE AND CIGARETTE FILTER ELEMENT THEREFOR

[75] Inventors: Barry L. Saintsing, Lexington; Thomas A. Perfetti, Winston-Salem; Jerry W. Redding, Lexington, all of N.C.

[73] Assignee: R. J. Reynolds Tobacco Company, Winston-Salem, N.C.

[21] Appl. No.: 894,733

[22] Filed: Jun. 5, 1992

Related U.S. Application Data

[63] Continuation of Ser. No. 621,499, Dec. 7, 1990, abandoned, which is a continuation-in-part of Ser. No. 606,287, Nov. 6, 1990, Pat. No. 5,105,834.

[51] Int. Cl.[5] ..... A24D 3/02

[52] U.S. Cl. ..... 131/335; 131/342; 131/343; 131/344

[58] Field of Search ..... 131/334, 335, 341-344

[56] References Cited

U.S. PATENT DOCUMENTS

| | | | |
|---|---|---|---|
| 2,001,709 | 5/1935 | Davidson . | |
| 2,202,839 | 6/1940 | Davidson . | |
| 2,948,282 | 8/1960 | White . | |
| 3,144,024 | 8/1964 | Eichwald et al. | 131/335 |
| 3,219,041 | 11/1965 | Bromberg . | |
| 3,313,305 | 4/1967 | Noznick et al. . | |
| 3,319,630 | 5/1967 | Orrmins . | |
| 3,353,543 | 11/1967 | Sproull et al. . | |
| 3,368,566 | 2/1968 | Avedikian | 131/341 |
| 3,516,417 | 6/1970 | Moses . | |
| 3,584,630 | 6/1971 | Inskeep . | |
| 3,589,371 | 6/1971 | Laporte . | |
| 3,603,319 | 9/1971 | Badgett et al. . | |
| 3,635,226 | 1/1972 | Horsewell et al. . | |
| 3,768,489 | 10/1973 | Keifer . | |
| 3,849,241 | 11/1974 | Butin et al. . | |
| 4,022,222 | 5/1977 | Berger | 131/344 |
| 4,059,121 | 11/1977 | Brackmann et al. | 131/341 |
| 4,173,504 | 11/1979 | Tomioka et al. . | |
| 4,188,960 | 3/1980 | Morie et al. . | |
| 4,194,517 | 3/1980 | Borowski . | |
| 4,273,600 | 6/1981 | Luke . | |
| 4,316,730 | 2/1982 | Eibl . | |
| 4,318,417 | 3/1982 | Hiroshi et al. . | |
| 4,350,173 | 9/1982 | Sirén . | |
| 4,355,995 | 10/1982 | Berger . | |
| 4,466,451 | 8/1984 | Bonnet et al. . | |
| 4,492,240 | 1/1985 | Hayes et al. . | |
| 4,546,040 | 10/1985 | Knotek et al. . | |
| 4,677,995 | 7/1987 | Kallianos et al. . | |
| 4,700,723 | 10/1987 | Yoshikawa et al. | 131/334 |
| 4,752,348 | 6/1988 | Bryant et al. | 131/343 |
| 4,763,674 | 8/1988 | Lelah . | |
| 4,793,365 | 12/1988 | Sensabaugh, Jr. et al. . | |
| 4,800,903 | 1/1989 | Ray et al. . | |
| 4,807,809 | 2/1989 | Pryor et al. . | |
| 4,811,745 | 3/1989 | Cohen et al. . | |
| 4,836,224 | 7/1989 | Lawson et al. . | |
| 4,858,629 | 8/1989 | Cundari . | |
| 4,889,143 | 12/1989 | Pryor et al. . | |
| 4,964,426 | 10/1990 | Lee et al. . | |
| 4,971,078 | 11/1990 | Deutsch et al. . | |
| 5,009,239 | 4/1991 | Cohen et al. . | |
| 5,012,829 | 5/1991 | Thesing et al. | 131/344 |
| 5,076,294 | 12/1991 | Kramer . | |
| 5,076,295 | 12/1991 | Saintsing . | |

FOREIGN PATENT DOCUMENTS

| | | |
|---|---|---|
| 0250806 | 1/1988 | European Pat. Off. . |
| 0304759 | 3/1989 | European Pat. Off. . |
| 0330709 | 9/1989 | European Pat. Off. . |
| 0346648 | 12/1989 | European Pat. Off. . |
| 0363288 | 4/1990 | European Pat. Off. . |
| 0383018 | 8/1990 | European Pat. Off. . |
| 2170391 | 1/1985 | United Kingdom . |
| 2190275 | 11/1987 | United Kingdom . |
| 2201879 | 9/1988 | United Kingdom . |

OTHER PUBLICATIONS

Publication No. FTR-80, Published by Eastman Kodak Chemical Company.

*Primary Examiner*—Vincent Millin
*Assistant Examiner*—J. Doyle

[57] ABSTRACT

A cigarette comprises a blend of tobacco materials and a filter element provided from a non-woven thermoplastic material. The non-woven material comprises polyester or polypropylene fibers. The non-woven material is in intimate contact with an acidic material (e.g., phosphoric acid) or a basic material (e.g., sodium hydroxide).

36 Claims, 1 Drawing Sheet

CIGARETTE AND CIGARETTE FILTER ELEMENT THEREFOR

CROSS-REFERENCE TO RELATED APPLICATION

This is a continuation of application Ser. No. 07/621,499, filed 7 Dec. 1990, now abandoned, which is a continuation-in-part of U.S. patent application Ser. No. 606,287, filed Nov. 6, 1990, now U.S. Pat. No. 5,105,834 the disclosure of which is incorporated herein by reference.

BACKGROUND OF THE INVENTION

The present invention relates to smoking articles such as cigarettes, and in particular to filter elements for cigarettes.

Popular smoking articles, such as cigarettes, have a substantially cylindrical rod shaped structure and include a charge of smokable material such as shredded tobacco (e.g., cut filler) surrounded by a paper wrapper, thereby forming a so-called "tobacco rod." It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Cigarettes are employed by the smoker by lighting one end thereof and burning the tobacco rod. The smoker then receives mainstream smoke into his/her mouth by drawing on the opposite end (i.e., the filter end) of the cigarette. Drawn smoke passes through the filter element before reaching the mouth of the smoker.

It would be desirable to provide a cigarette having a filter element which is capable of providing controlled yields of flavorful mainstream smoke.

SUMMARY OF THE INVENTION

The present invention relates to smoking articles, such as cigarettes. A smoking article of the present invention comprises a filter element. The filter element includes a segment (e.g., a rod shaped segment) having a filter material which preferably comprises thermoplastic fibers. The filter material comprising the thermoplastic fibers normally is a non-woven filter material. The filter material is in intimate contact with a basic material or an acidic material, either of which is capable of altering the characteristics of mainstream smoke which passes through the segment during use of the smoking article. Such a segment is referred to as a "smoke-altering filter segment." Normally, prior to smoking the cigarette, the smoke-altering filter segment includes at least about 0.1 percent acidic or basic material, based on the weight of the filter material.

The smoke-altering filter segment optionally can include a tobacco extract in intimate contact with the filter material. If desired, the tobacco extract can be a spray dried tobacco extract which has been subjected to heat treatment. Normally, prior to smoking the cigarette, the smoke-altering filter segment includes up to about 60 percent of the optional tobacco extract, based on the dry weight of the filter material and optional tobacco extract in intimate contact therewith.

Preferred acidic materials are strong acids, such as phosphoric acid. Preferred acidic materials are those which exhibit a $pK_a$ at 25° C. of less than about 3, and more preferably less than about 2.5. Preferred basic materials are strong bases, such as sodium hydroxide. Preferred basic materials are those which exhibit a $pK_b$ at 25° C. of less than about 3, and more preferably less than about 2.5.

Preferred filter materials which are intimately contacted with the acidic and basic materials are essentially chemically inert with those acidic and basic materials under those conditions at which the smoking article into which the smoke-altering filter segment is incorporated is made, stored and used.

Although less preferred, smoking articles of the present invention can include filter elements having the acidic and basic materials carried by a substrate, such as particles of carbon or alumina. The acidic and basic materials carried by such substrates then can be dispersed within the filter material of a filter segment or positioned within a cavity (e.g., within a cavity of a so-called "triple filter."

The filter element can include only a smoke-altering filter segment. However, the filter element preferably includes such a segment combined with at least one other filter segment. Normally, the smoke-altering segment includes fibers of polyester, polypropylene or polyethylene; and the other filter segment with which the smoke-altering filter segment is combined includes non-woven cellulose acetate tow or non-woven cellulose acetate web. If desired, the filter element can include (i) a smoke-altering filter segment containing an acidic material, (ii) a smoke-altering filter segment containing a basic material, and (iii) at least one other filter segment.

Smoking articles of the present invention (i.e., which have smoke-altering filter segments incorporated therein) can have various forms. Preferred smoking articles are rod shaped. For example, the smoking article can have the form of a cigarette having a smokable material (e.g., tobacco cut filler) wrapped in a circumscribing paper wrapping material. Exemplary cigarettes are described in U.S. Pat. No. 4,561,454 to Guess; U.S. Pat. No. 4,924,883 to Perfetti et al; U.S. Pat. No. 4,924,888 to Perfetti et al; U.S. Pat. No. 4,941,485 to Perfetti et al; U.S. Pat. No. 4,941,486 to Dube et al and U.S. Pat. No. 4,942,888 to Montoya et al; as well as U.S. patent application Ser. Nos. 528,302, filed May 24, 1990; 567,520, filed Aug. 15, 1990 and 601,551, filed Oct. 23, 1990. Other suitable smoking articles are described in U.S. Pat. No. 4,771,795 to White et al; U.S. Pat. No. 4,714,082 to Banerjee et al; U.S. Pat. No. 4,756,318 to Clearman et al; U.S. Pat. No. 4,793,365 to Sensabaugh et al; U.S. Pat. No. 4,827,950 to Banerjee et al; U.S. Pat. No. 4,938,236 to Banerjee et al and U.S. Pat. No. 4,955,399 to Potter et al; European Patent Application Nos. 212,234; 277,519; 280,990 and 305,788; and U.S. patent application Ser. Nos. 486,025, filed Feb. 27, 1990; 574,327, filed Aug. 29, 1990 and 576,751, filed Aug. 29, 1990.

DETAILED DESCRIPTION OF THE PREFERRED EMBODIMENTS

Figure 1:
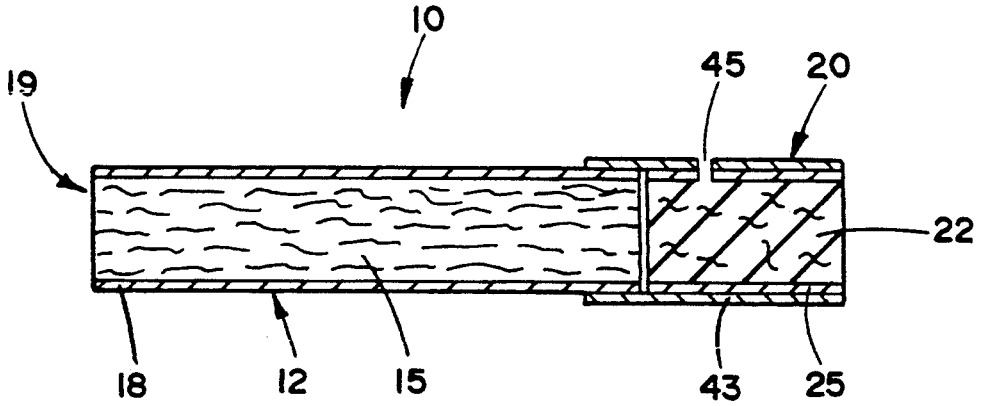
FIGS. 1, 2 and 3 are longitudinal, sectional views of rod-shaped smoking articles representative of the present invention.
Figure 2:
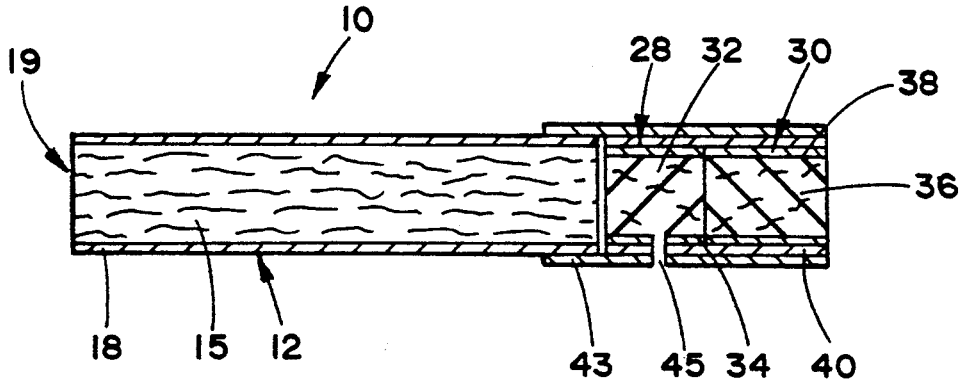

Representative embodiments of smoking articles of the present invention are shown in FIGS. 1 and 2. Cigarette 10 includes a generally cylindrical rod 12 of a charge or roll of smokable filler material 15 to be burned contained in circumscribing wrapping material 18. The rod 12 is conveniently referred to as a "smokable rod" or a "tobacco rod." The ends of the tobacco rod are open to expose the smokable filler material. The smokable rod is used by lighting one end 19 thereof, and aerosol (e.g., smoke) is provided as a result of the combustion of the burning smokable material. As such, the smokable rod burns from the lit end thereof towards the opposite end thereof.

Typically, the tobacco rod 12 has a length which ranges from about 50 mm to about 85 mm, and a circumference of about 16 mm to about 28 mm. The tobacco rods and the resulting cigarettes can be manufactured in any known configuration using known cigarette making techniques and equipment. The tobacco rod can have two layers of circumscribing paper wrapping material, if desired.

Referring to FIG. 1, cigarette 10 normally includes a filter element 20 positioned adjacent one end of the tobacco rod 12 such that the filter element and tobacco rod are axially aligned in an end-to-end relationship, preferably abutting one another. Filter element 20 has a generally cylindrical shape, and the diameter thereof is essentially equal to the diameter of the tobacco rod 12. The ends of the filter element are open to permit the passage of air and smoke therethrough. The filter element 20 includes filter material 22 which is overwrapped along the longitudinally extending surface thereof with circumscribing plug wrap material 25.

Typically, the filter element 20 has a length which ranges from about 20 mm to about 35 mm and a circumference of about 16 mm to about 28 mm. The plug wrap 25 typically is a conventional paper plug wrap, and can be either air permeable or essentially air impermeable.

Filter element 20 includes a thermoplastic filter material 22 which is in intimate contact with a basic material or an acidic material. The filter element comprises sufficient acidic or basic material so as to be capable of altering the flavor characteristics of the mainstream smoke of the cigarette which passes through the filter element. As such, there is provided a smoke-altering filter segment.

Referring to FIG. 2, cigarette 10 includes a filter element 20 having a first cylindrical filter segment 28 and second cylindrical filter segment 30. Filter element 20 has a generally cylindrical shape, and the diameter thereof is essentially equal to the diameter of the tobacco rod 12. The first and second segments are longitudinally disposed relative to one another. The first filter segment 28 is positioned adjacent one end of the tobacco rod 12, and the second filter segment is positioned adjacent one end of the first filter segment at the extreme mouth end of the cigarette. The first filter segment 28 includes a first filter material 32 which is overwrapped along the longitudinally extending surface thereof with a circumscribing plug wrap material 34. The second filter segment 30 includes a second filter material 36 which is similarly overwrapped with a plug wrap material 38. The filter segments 28, 30 are axially aligned in an end-to-end relationship, preferably abutting one another; and are maintained in place by circumscribing outer plug wrap material 40. The inner surface of the outer plug wrap 40 is fixedly secured to the outer surfaces of the plug wraps of respective filter segments 28 and 30. The filter segments can be provided in the desired alignment using plug tube combination machinery which is familiar to the skilled artisan.

Normally, the first filter segment 28 includes filter material 32 in intimate contact with an acidic material or a basic material. That is, the first filter segment includes a filter material which includes thermoplastic fibers and is a smoke-altering segment. The second filter segment 30 normally includes filter material 36 which has the form of plasticized cellulose acetate tow, nonwoven cellulose acetate web, polypropylene tow, gathered non-woven polypropylene web, or the like. The second segment can be a nonwrapped cellulose acetate filter element, if desired. Examples of cellulose acetate tow are tow items available as 8 denier per filament, 40,000 total denier; 2.7 denier per filament, 39,000 total denier, and 3 denier per filament, 35,000 total denier. Cellulosic acetate tow typically is plasticized using triacetin. Most preferably, the filter materials of each of the first and second segments are different from one another. Flavors and other smoke modifying agents can be incorporated into the first and/or second filter segments, if desired. Various second segments can be provided from filter rods which are manufactured using known techniques and machinery.

Figure 3:
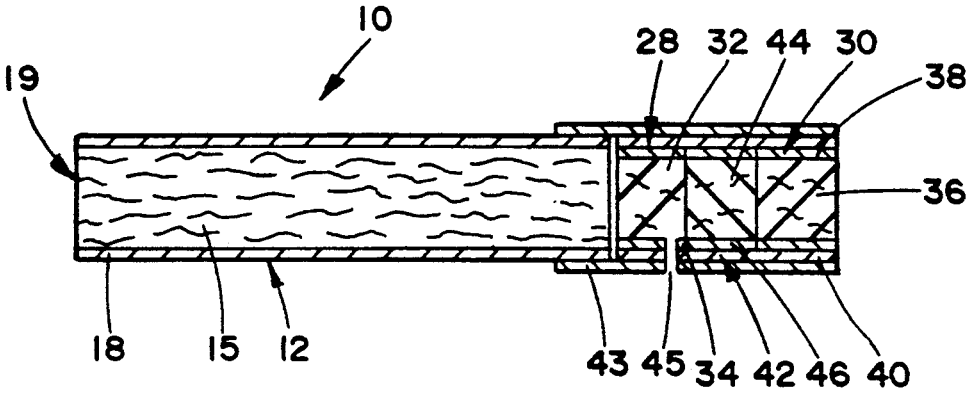

Referring to FIG. 3, cigarette 10 includes a filter element 20 having a first cylindrical filter segment 28, a second cylindrical filter segment 30, and a third cylindrical filter segment 42 positioned between the first and second filter segments. The third filter segment 42 includes a filter material 44 which is overwrapped with a plug wrap material 46. The filter elements 20, 28 and 42 are axially aligned in an end-to-end relationship, preferably abutting one another; and are maintained in place by circumscribing outer plug wrap material 40.

Normally, the first filter segment 28 includes filter material 32 in intimate contact with a basic material; the second filter segment 30 includes filter material 36, such as cellulose acetate tow; and the third filter segment 42 includes filter material 44 in intimate contact with an acidic material. Alternatively, the filter segment having filter material in intimate contact with the acidic material can be positioned adjacent the tobacco rod, and the filter segment having filter material in intimate contact with the basic material can be positioned between the second filter segment 30 and the filter segment positioned adjacent the tobacco rod.

Referring to FIGS. 1, 2 and 3, filter element 20 is attached to the tobacco rod 12 using tipping material 53 which circumscribes both the entire length of the filter element and an adjacent region of the tobacco rod. The inner surface of the tipping material 43 is fixedly secured to the outer surface of the filter element 20 and the outer surface of the wrapping material 18 of the tobacco rod, using a suitable adhesive. A preferred ventilated or air diluted cigarette is provided with an air dilution means such as a series of perforations 55 each of which extend through the tipping material and plug wrap. Preferably, the series of perforations is positioned such that air drawn through those perforations passes through at least a portion of the length of the first filter segment 28 to the mouth of the smoker.

The filter materials useful for providing the smoke-altering filter segments can vary. Normally, the filter material is provided from a material which is a synthetic addition or condensation polymer. The filter material is essentially chemically inert to the basic materials and acidic materials in contact therewith. Preferred filter materials are synthetic polymers. Polymers such as acetylated cellulosics (e.g., cellulose acetate) have a tendency to be chemically reactive with strong acids and strong bases.

One type of material useful for providing the filter material for the smoke-altering filter segment comprises polyester fibers. See, for example, U.S. patent application Ser. No. 518,597, filed May 3, 1990, which is incorporated herein by reference. Polyesters are synthetic polymers which commonly are made by esterifying polybasic organic acids with polyhydric alcohols. For example, dimethyl terephthalate and ethylene glycol can be reacted to form polyethylene terephthalate. Polyester fibers can make up the total composition of the filter material. Alternatively, that filter material can be a mixture or blend of polyester fibers with wood pulp, polyolefin fibers (e.g., polyethylene or polypropylene fibers), cotton fibers, or the like. Typically, the filter material comprises at least about 25 percent polyester fibers, preferably at least about 40 percent polyester fibers, based on the weight of that filter material. The filter material can have the form of a non-woven web of fibers or a tow. Alternatively, the filter material can have a sheet-like form, particularly when the material is formed from a mixture of polyester fibers and wood pulp. Filter material in web or sheet-like form can be gathered, folded or otherwise formed into a suitable (e.g., cylindrical) configuration using techniques which will be apparent to the skilled artisan. See, for example, U.S. Pat. No. 4,807,809 to Pryor et al and U.S. patent application Ser. No. 585,444, filed Sep. 20, 1990, which are incorporated herein by reference.

Another type of material useful for providing the filter material of the smoke-altering filter segment includes polyester fibers available as 4SW Fiber from Eastman Chemical Company. A preferred filter material is a non-woven web comprising 4SW Fiber, and is available as 4TD Non-woven Web from Eastman Chemical Co. Preferably, such a filter material is provided as a sheet-like web in contact with about 0.1 to about 3 weight percent of a lubricant, such as mineral oil or polyethylene glycol monolaurate (e.g., PEG-600 monolaurate). See, also, U.S. patent application Ser. No. 033,651, filed Apr. 4, 1989 and U.S. patent application Ser. No. 592,723, filed Oct. 4, 1990, which are incorporated herein by reference.

Another type of material useful for providing the filter material of the smoke-altering filter segment includes polypropylene fibers. A highly preferred sheet-like web of non-woven polypropylene fiber is available as PP200SD from Kimberly-Clark Corp. Such a web can be manufactured using a melt blowing process as is described in U.S. Pat. No. 3,849,241 to Buntin et al. See, for example, European Patent Application No. 330,709 and U.S. patent application Ser. No. 414,835, filed Sep. 29, 1989, now U.S. Pat. No. 5,076,295 to Saintsing which are incorporated herein by reference.

Another type of material useful for providing the filter material of the smoke-altering filter segment includes polyethylene fibers. Polyethylene fibers can make up the total composition of the filter material of the flavor-containing filter material. Alternatively, that filter material can be a mixture or blend of polyethylene fibers with wood pulp, polypropylene fibers, polyester fibers, cotton fibers, or the like. Typically, the filter material comprises at least about 25 percent polyethylene fibers, preferably at least about 40 percent polyethylene fibers, and often greater than 50 percent polyethylene fibers, based on the weight of that filter material. The filter material can have the form of a non-woven web of fibers or a tow. Alternatively, the filter material can have a sheet-like form, particularly when the material is formed from a mixture of polyethylene fibers and wood pulp. Filter material in web or sheet-like form can be gathered, folded or otherwise formed into a suitable (e.g., cylindrical) configuration using techniques which will be apparent to the skilled artisan. See, for example, U.S. patent application Ser. No. 541,007, filed Jun. 20, 1990, which is incorporated herein by reference.

Combinations of various synthetic addition or combination polymers can be used as the smoke-altering filter material in intimate contact with acids or bases. Second filter segments can be synthetic polymers, cellulosics, acetylated cellulosics, cotton fibers or combinations or composites of the above filter materials.

As the composition of the filter material, the form of the filter material and the configuration of the filter material can vary, the filtration efficiency for particulate matter and vapor phase components of each ultimate filter segment can vary from relatively low to relatively high.

The acidic materials are materials or substances which behave as Bronstead acids, and have functionalities which can provide protons. Acidic materials which are employed are strong acids, and typically are water soluble inorganic acids. Typical acidic materials are those which exhibit a $pK_a$ at 25° C. of less than about 3, preferably less than about 2.5, more preferably less than about 2 and most preferably less than about 1. Exemplary inorganic acids are phosphoric acid and sulfuric acid.

The basic materials are materials or substances which behave as Lewis bases, and have functionalities which can provide electron pairs. Basic materials which are employed are strong bases, and typically are water insoluble inorganic bases. Typical basic materials are those which exhibit a $pK_b$ at 25° C. of less than about 3, preferably less than about 2.5, more preferably less than about 2, and most preferably less than about 1. Exemplary inorganic bases are metal hydroxides (e.g., sodium and potassium hydroxides).

A typical filter material in intimate contact with the basic material or acidic material includes up to about 50 percent, usually up to about 30 percent and frequently up to about 10 percent basic material or acidic material, based on the weight of the filter material. A typical filter material in intimate contact with the basic material or acidic material includes more than about 0.1 percent, usually more than 0.5 percent, frequently more than 1 percent, and sometimes more than about 3 percent basic material or acidic material, based on the weight of the filter material.

The amount of acidic material or basic material within the smoke-altering filter segments of cigarettes of the types described with reference to FIGS. 1, 2 and 3 (i.e., cigarettes which burn smokable material, such as tobacco cut filler, present in the smokable rod to produce mainstream smoke) typically incorporate up to about 15 percent, and frequently up to about 20 percent acidic material or basic material within the smoke-altering filter segment, based on the weight of the smokable material within the cigarette. Typically, cigarettes having the smoke-altering filter segments incorporate more than about 0.02 percent, and frequently more than about 5 percent acidic material or basic material, based on the weight of the smokable material within the cigarette.

A typical smoke-altering filter material having a basic material in intimate contact with a filter material exhibits a pH at 25° C. of about greater than about 8 units, usually greater than about 9 units, and frequently greater than about 10 units.

A typical smoke-altering filter material having an acidic material in intimate contact with a filter material exhibits a pH at 25° C. of less than about 6 units, usually less than about 4 units, and frequently less than about 2 units.

For purposes of the present invention, the pH of the smoke-altering filter material is determined by contacting the filter segment with distilled water, and the pH of the resulting liquid is measured using a properly calibrated hydrogen ion electrode pH meter. As such the pH of the filter segment is a so-called "solution pH."

The manner in which the smoke-altering filter segments are provided can vary. Typically, the acidic material or basic material is provided within a liquid (e.g., water) and the liquid is applied to a web or sheet of the filter material using a rotogravure or size press technique, and the web or sheet is removed from the liquid. If desired, the acidic material or basic material can be provided within a liquid (e.g., water) and then sprayed onto the filter material or injected into contact with the filter material.

Preferred tobacco extracts which optionally are intimately contacted with the filter materials are tobacco extracts which are provided by extracting a tobacco material with a solvent having an aqueous character (i.e., a solvent consisting primarily of water, preferably greater than 90 weight percent water, and often essentially pure water). The specific composition of the tobacco extract can vary, depending upon factors such as the type of tobacco material which is extracted, the extraction solvent and the type of extraction conditions. Although the nicotine contents of such extracts can vary, preferred tobacco extracts have nicotine contents of less than about 50 percent, usually of less than about 25 percent, and frequently less than about 15 percent, based on the dry weight of the extract. Such preferred tobacco extracts have relatively high contents of many of the flavorful components of tobacco. Methods for preparing and processing tobacco extracts are set forth in European Patent Application Nos. 326,370 and 338,831, which are incorporated herein by reference. Other tobacco extracts are those extracts which are subjected to heat treatment, such as those tobacco extracts set forth in U.S. patent application Ser. Nos. 346,042, filed May 2, 1989; 452,175, filed Dec. 18, 1989; 511,158, filed Apr. 19, 1990; and 536,250, filed Jun. 11, 1990, which are incorporated herein by reference.

Typically the tobacco extract is provided within a liquid, applying the liquid and extract to a web or sheet of the filter material using a rotogravure or size press technique, and removing the liquid the web or sheet. If desired, the tobacco extract can be provided within a liquid carrier, and then sprayed onto the filter material. The optional tobacco extract can be contacted with the filter material before, while, or after, the strongly acidic material or strongly basic material is contacted with the filter material. The tobacco extract can be a spray dried extract, a freeze dried extract or a tobacco essence which is in turn dissolved or otherwise dispersed in water or other liquid carrier in order to be applied to the filter material. Typically, the tobacco extract which optionally is in intimate contact with the filter material has a moisture content of about 5 to about 6 weight percent, although the moisture content of a particular tobacco extract can vary.

Typical filter materials in intimate contact with the optional tobacco extract include up to about 60 percent, preferably about 5 to about 55 percent, more preferably about 10 to about 45 percent, and most preferably about 20 to about 40 percent tobacco extract, based on the total dry weight of the filter material and optional tobacco extract, prior to the time that the cigarette into which the resulting filter element is incorporated is smoked.

The acidic materials can be combined with further acidic materials and/or salts; and the basic materials can be combined with further basic materials and/or salts. Such further acidic materials can include acids, such as organic acids. Typical organic acids comprise at least one carboxylic acid functionality. Exemplary organic acids include levulinic, pyruvic, malic, malonic, maleic, tartaric, citric, oxalic, lactic, fumaric, adipic, acetic, propionic, phenylacetic, butyric, isovaleric, caproic, caprylic and capric acids. Exemplary organic acids also can include the amino acids, such as serine, theonine, phenylalanine, glutamine, proline, asparagine, aspartic acid and glutamic acid. Certain acids, such as the amino acids, contain both acidic and basic functionalities. The further basic materials can include organic bases. An exemplary organic base is urea. The further materials can include salts, such as inorganic salts of organic acids, salts of inorganic acids and organic salts of organic acids. Exemplary salts include the sodium, potassium, calcium and magnesium salts of the previously mentioned organic acids; the sodium, potassium, calcium and magnesium salts of phosphoric acid, boric acid, and carbonic acid; ammonium salts of phosphoric acid, carbonic acid and the previously mentioned organic acids; and the nicotine salts of the previously mentioned organic acids. The nicotine salts of the organic acids typically have molar ratios of organic acid to nicotine of 1:1, 2:1 and 3:1. Exemplary nicotine salts of organic acids are set forth in U.S. Pat. No. 4,830,028 to Lawson et al, which is incorporated herein by reference.

The amount of optional further acidic material, basic material or salt which is intimately contacted with the filter material can vary; but typically is less than about 5 percent, based on the weight of the filter material. The optional further material can be contacted with the filter material by injection techniques, size press techniques, rotogravure techniques, or the like. The further material can be contacted with the filter material before, while, or after, the strongly acidic material or strongly basic material is contacted with the filter material.

The filter materials also can include minor amounts of lubricating substances. Exemplary lubricating substances include polyhydric alcohols (e.g., glycerin, propylene glycol, or the like), fatty acids, mineral oils, vegetable oils and polyethylene glycol esters of fatty acids. The lubricating substance provides flexibility to the web or tow; improves the ability of additives to spread evenly throughout the filter material; and provides a web or tow which can be shaped without the application of heat.

Typical filter materials in intimate contact with the acidic or basic material and optional lubricating substance include up to about 10 percent, preferably up to about 5 percent lubricating substance, based on the total dry weight of the filter material, acidic or basic material and optional lubricating substance, prior to the time that the cigarette into which the resulting filter segment is incorporated is smoked. The optional lubricating substance is intimately contacted with the filter material and is contacted with that filter material in much the same manner as is the acidic or basic materials.

Other mainstream smoke altering materials which include materials for enhancing the flavor characteristics of the mainstream smoke also can be employed. Such materials include cocoa, licorice, sugars, syrups, menthol and spearmint, as well as Amadori compounds and amino sugars (e.g., glucosamine and asparaginofructose).

The smokable materials useful herein can vary. Examples of highly preferred smokable materials are the tobacco materials which include flue-cured, Oriental, Maryland and Burley tobaccos, as well as the rare and specialty tobaccos. Generally, the tobacco material has been aged. The tobacco material can be in the form of tobacco laminae, processed tobacco stems, reconstituted tobacco material, volume expanded tobacco filler, or blends thereof. The type of reconstituted tobacco material can vary (i.e., the reconstituted tobacco material can be manufactured using a variety of reconstitution processes). Blends of the aforementioned materials and tobacco types can be employed. Exemplary blends are described in U.S. patent application Ser. No. 427,547, filed Oct. 26, 1989. Other smokable materials, such as those smokable materials described in U.S. patent application Ser. Nos. 414,833, filed Sep. 29, 1989 and 416,332, filed Sep. 29, 1989, also can be employed. The smokable materials generally are employed in the form of cut filler as is common in conventional cigarette manufacture. For example, the smokable filler material can be employed in the form of pieces, shreds or strands cut into widths ranging from about 1/5 inch to about 1/60 inch, preferably from about 1/20 inch to about 1/40 inch. Generally, such pieces have lengths which range from about 0.25 inch to about 3 inches.

The filler materials can be employed with or without casing or top dressing additives. See, for example, Leffingwell et al, *Tobacco Flavoring for Smoking Products* (1972). Flavorants such as menthol can be incorporated into the cigarette using techniques familiar to the skilled artisan. If desired, flavor additives such as organic acids can be incorporated into the cigarette as additives to the cut filler. See, for example, U.S. Pat. No. 4,830,028 to Lawson et al.

The wrapping material which circumscribes the charge of smokable filler can vary. Examples of suitable wrapping materials are cigarette paper wrappers available as Ref. No. 719, 754, 756, 854 and 856 from Kimberly-Clark Corp. also suitable are cigarette paper wrappers available as P-2123-101, P-2123-102, P-2123-104, P-2123-106, P-2123-107, P-2123-108, P-2123-109, P-2123-111, P-2123-112, P-2123-114, from Kimberly-Clark Corp.; and Cigarette paper wrappers available as TOD 01788, TOD 03363, TOD 03732, TOD 03957, TOD 03949, TOD 03950, TOD 03953, TOD 03954, TOD 04706, TOD 04742 and TOD 04708 from Ecusta Corp. Certain paper wrappers have low inherent air permeabilities (e.g., permeabilities of less than about 15 CORESTA units). A particularly preferred paper wrapper is a low permeability, high basis weight paper having a high surface area calcium carbonate filler and a relatively high application of potassium succinate burn additive. Such a paper is available as P-2123-114 from Kimberly-Clark Corp. Another suitable paper wrapper (i) has a low inherent permeability, high basis weight paper having a calcium carbonate and magnesium hydroxide filler, and a potassium acetate burn chemical, and (ii) has been electrostatically perforated so as to have a relatively high net permeability (e.g., a net permeability of greater than 50 CORESTA units). Such papers are available as TOD 03732 and TOD 04742 from Ecusta Corp. More than one layer of circumscribing wrapping material can be employed, if desired.

Typically, the tipping material circumscribes the filter element and an adjacent region of the smokable rod such that the tipping material extends about 3 mm to about 6 mm along the length of the smokable rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents, thereby providing a means for providing air dilution to the cigarette. The total surface area of the perforations and the positioning of the perforations along the periphery of the cigarette can be varied in order to control the performance characteristics of the cigarette. Preferably, the air dilution means is positioned along the length of the cigarette at a point along the filter element which is at a maximum distance from the extreme mouthend thereof. The maximum distance is dictated by factors such as manufacturing constraints associated with the type of tipping employed and the cigarette manufacturing apparatus and process. For example, for a filter element having a 27 mm length, the maximum distance may range from about 23 mm to about 26 mm from the extreme mouthend of the filter element.

As used herein, the term "air dilution" is the ratio (generally expressed as a percentage) of the volume of air drawn through the air dilution means to the total volume of air and smoke drawn through the cigarette and exiting the extreme mouthend portion of the cigarette. For air diluted or ventilated cigarettes of this invention, the amount of air dilution can vary. Generally, the amount of air dilution for an air diluted cigarette is greater than about 10 percent, typically greater than about 20 percent, and often greater than about 30 percent. Typically, for cigarettes of relatively small circumference (i.e., about 21 mm or less) the air dilution can be somewhat less than that of cigarettes of larger circumference. The upper limit of air dilution for a cigarette typically is less than about 85 percent, more frequently less than about 75 percent.

Cigarettes of the present invention exhibit a desirably high resistance to draw. For example, cigarettes of this invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of this invention preferably exhibit resistance to draw values of about 70 to about 180, more preferably about 80 to about 150 mm water pressure drop at 17.5 cc/sec. air flow.

The following example is provided in order to further illustrate various embodiments of the invention but should not be construed as limiting the scope thereof. Unless otherwise noted, all parts and percentages are by weight.

EXAMPLE 1

Cigarettes substantially as shown in FIG. 2 are prepared as follows:

The cigarettes have a length of about 84 mm and a circumference of about 24.8 mm, and include a smokable rod having a length of about 57 mm and a filter element having a length of about 27 mm. Each smokable rod comprises a blend of smokable material circumscribed by a single layer of paper wrapper. The weight of the smokable material within each smokable rod is about 0.665 g. Each filter element includes two segments. The first segment is a smoke-altering filter segment. The first filter segment is positioned adjacent the smokable rod. The second segment includes cellulose acetate tow (3.3 denier per filament, 35,000 total denier) plasticized with triacetin and circumscribed by non-porous paper plug wrap. The second filter segment has a length of 15 mm, and is positioned adjacent the first filter segment. Each filter element is attached to each tobacco rod using non-porous tipping paper. For each cigarette, the tipping paper circumscribes the filter element and a 4 mm length of the tobacco rod in the region adjacent the filter element. The cigarettes are not air diluted.

The filter material of the first filter segment is a continuous non-woven sheet-like web available as 4TD from Eastman Chemical Co. The web includes polyester fibers available as 4SW from Eastman Chemical Company. The web has a basis weight of about 1.25 oz/yd$^2$, and a width of about 7.75 inches. The web has less than about 1 percent mineral oil applied thereto. The web has a strong base in intimate contact therewith. The first filter segment is provided by subdividing a rod provided by gathering the continuous web from a bobbin using the apparatus described in U.S. patent application Ser. No. 585,444, filed Sep. 20, 1990. The apparatus is similar to that rod making apparatus described in Example 1 of U.S. Pat. No. 4,870,809 to Pryor et al, and includes a constriction member (i.e., tongue) fashioned so that a continuous supply of water is applied to the web-contacting surface of the tongue. Each filter segment so provided includes a circumscribing non-porous paper plug wrap, and weighs about 0.118 g.

The first filter segment has sodium hydroxide incorporated therein, so that the sodium hydroxide is in intimate contact with the filter material. In particular, the base is dissolved in water so as to provide a basic solution of about 10 percent concentration, and about 2.8 microliters of the basic solution is injected into the first filter segment using a syringe. As such, the first filter segment includes more than 2 percent sodium hydroxide in intimate contact with the filter material, based on the weight of the filter material. The filter segment then is allowed to set for at least 24 hours.

The paper wrapper of the smokable rod comprises flax and calcium carbonate. The paper wrapper is available as Reference No. 854 from Kimberly-Clark Corp.

The smokable material is a blend of volume expanded flue-cured and Burley tobacco laminae, flue-cured tobacco laminae, Burley tobacco laminae, reconstituted tobacco and Oriental tobacco laminae. The smokable material is in the form of laminae cut into strands at 32 cuts per inch. The volume expanded tobacco is tobacco laminae which is cut into cut filler form and which has been expanded.

The blend of smokable materials is cased and top dressed with humectants and flavors, and is provided so as to have total moisture content of about 12 percent. The filter elements of 5 cigarettes are cut away from the tobacco rod by cutting through the tipping paper. The filter elements are cut length-wise into 4 segments and placed into 100 ml of distilled water. The filter elements are allowed to soak in the water and agitated for about 12 hours. The pH of the liquid then is measured at 25° C. using a Model 107 Corning pH/°C. Meter. The pH of filter elements measured in this manner is 8.0 units.

The cigarettes then are employed by burning the smokable rod such that the blend of smokable material within the paper wrapper burns to yield smoke. The resulting cigarette provides good tobacco flavor, and the mainstream smoke thereof is smoother tasting than a similar cigarette not having sodium hydroxide incorporated into the first filter segment. The cigarette yields a satisfying, rounded smoking character.

EXAMPLE 2

Cigarettes are provided as described in Example 1, except that the cigarette is air diluted to a level of 50 percent by providing a ring of perforations through the tipping material about 13 mm from the extreme mouthend of the cigarette.

EXAMPLE 3

A cigarette is provided as described in Example 1, except that the first filter segment includes phosphoric acid in intimate contact with the filter material. In particular, about 14 microliters of an aqueous solution of phosphoric acid having a concentration of about 1 percent is injected into the filter segment.

The cigarette is smoked as described in Example 1, and provides mainstream smoke which is very mild. The cigarette provides mainstream smoke having a low impact yet flavorful, smooth tobacco taste having slight woody and peppery notes.

EXAMPLE 4

Cigarettes are provided as described in Example 2, except that the cigarette is air diluted to a level of 50 percent by providing a ring of perforations through the tipping material about 13 mm from the extreme mouthend of the cigarette.

EXAMPLE 5

Cigarettes are provided in the manner described in Example 1, except that the first filter segment is provided by gathering or pleating a non-woven web of polypropylene fibers using the rod forming apparatus described in Example 1. The web has a width of 11.75 inches, a basis weight of about 0.7 oz/yd$^2$, and is available as PP200SD from Kimberly-Clark Corp.

The first filter segment has sodium hydroxide incorporated therein, so that the sodium hydroxide is in intimate contact with the filter material. In particular, the base is dissolved in water so as to provide a basic solution of about 10 percent concentration, and about 2.3 microliters of the acid solution is injected into the first filter segment using a syringe. The filter segment then is allowed to set for at least 24 hours.

The pH of the filter element is determined as described in Example 1 and is 8.0 units.

The cigarette is smoked as described in Example 1, and provides pleasant tasting mainstream smoke which is mild and smooth in character.

EXAMPLE 6

Cigarettes are provided as described in Example 5, except that the cigarette is air diluted to a level of 50 percent by providing a ring of perforations through the tipping material about 13 mm from the extreme mouth-end of the cigarette.

EXAMPLE 7

A cigarette is provided as described in Example 5, except that the first filter segment includes about 1 percent phosphoric acid in intimate contact with the filter material, based on the weight of the filter material. In particular, about 11.6 microliters of an aqueous solution of acid having a concentration of about 1 percent is injected into the filter segment.

EXAMPLE 8

Cigarettes are provided as described in Example 7, except that the cigarette is air diluted to a level of 50 percent by providing a ring of perforations through the tipping material about 13 mm from the extreme mouth-end of the cigarette.

EXAMPLE 9

A filter segment of a polyester and sodium hydroxide having a length of 10 mm is provided as set forth in Example 1. The filter segment so provided is used to replace the tobacco paper filter in the cigarette described in *Chemical and Biological Studies on New Cigarette Prototypes That Heat Instead of Burn Tobacco,* R. J. Reynolds Tobacco Co., (1988).

EXAMPLE 10

Cigarettes substantially as shown in FIG. 3 are prepared as follows:

The cigarettes are manufactured generally as described in Example 5, except that the first filter segment has a length of about 10 mm, the second filter segment has a length of about 11 mm, and the third filter segment has a length of about 10 mm. The second segment is the cellulose acetate filter segment described in Example 1. The first segment has sodium hydroxide in intimate contact with the non-woven web of polypropylene fibers. In particular, about 2.3 microliters of an aqueous solution of sodium hydroxide having a concentration of about 10 percent is injected into the filter segment. The third segment (which is positioned between the first and second segments) has phosphoric acid in intimate contact with the non-woven web of polypropylene fibers. In particular, about 2.3 microliters of an aqueous solution of phosphoric acid having a concentration of about 10 percent is injected into the filter segment.

EXAMPLE 11

Cigarettes substantially as shown in FIG. 1 are prepared essentially as described in Example 1, and employ the polypropylene described in Example 5 as the filter material. The length of the filter element is about 27 mm. About 7.4 microliters of an aqueous solution of sodium hydroxide having a concentration of about 10 percent is injected into the filter element.

EXAMPLE 12

A cigarette is provided as described in Example 11, except that the cigarette is air diluted to a level of 50 percent by providing a ring of perforations through the tipping material about 13 mm from the extreme mouth-end of the cigarette.

EXAMPLE 13

Cigarettes substantially as shown in FIG. 1 are prepared essentially as described in Example 1, and employ the polypropylene described in Example 5 as the filter material. The length of the filter element is about 27 mm. About 9.5 microliters of an aqueous solution of phosphoric acid having a concentration of about 10 percent is injected into the filter element.

EXAMPLE 14

A cigarette is provided as described in Example 13, except that the cigarette is air diluted to a level of 50 percent by providing a ring of perforations through the tipping material about 13 mm from the extreme mouth-end of the cigarette.

What is claimed is:

1. A cigarette having a charge of smokable material wrapped in a circumscribing paper wrapping material to form a smokable rod; the cigarette comprising a filter element positioned adjacent one end of the smokable rod; the filter element including a thermoplastic filter material in intimate contact with an acidic material having a $pK_a$ at 25° C. of less than about 3.

2. The cigarette of claim 1 wherein the filter material in intimate contact with the acidic material comprises more than about 0.1 percent acidic material, based on the weight of the filter material.

3. The cigarette of claim 1 wherein the acidic material includes phosphoric acid.

4. The cigarette of claims 1, 2 or 3 wherein the filter material comprises non-woven polyethylene fibers.

5. The cigarette of claims 1, 2 or 3 wherein the filter material comprises non-wove polyester fibers.

6. The cigarette of claims 1, 2 or 3 wherein the filter material comprises non-woven polypropylene fibers.

7. The cigarette of claim 1 wherein the filter element includes first and second longitudinally disposed filter segments; the first segment including a filter material in intimate contact with the acidic material being disposed adjacent the smokable rod, and the second segment including a non-woven filter material being disposed adjacent the first segment.

8. The cigarette of claim 7 wherein the non-woven filter material of the second segment includes non-woven cellulose acetate.

9. The cigarette of claim 7 wherein the filter material of the first segment comprises non-woven polyester fibers.

10. The cigarette of claim 7 wherein the filter material of the first segment comprises non-woven polypropylene fibers.

11. A cigarette having a charge of smokable material wrapped in a circumscribing paper wrapping material to form a smokable rod; the cigarette comprising a filter element positioned adjacent one end of the smokable rod; the filter element including a thermoplastic filter material in intimate contact with a basic material having a $pK_b$ at 25° C. of less than about 3.

12. The cigarette of claim 11 wherein the filter material in intimate contact with the basic material comprises more than about 0.1 percent basic material, based on the dry weight of the filter material.

13. The cigarette of claims 11 or 12 wherein the filter material comprises non-woven polyethylene fibers.

14. The cigarette of claims 11 or 12 wherein the filter material comprises non-woven polyester fibers.

15. The cigarette of claims 11 or 12 wherein the filter material comprises non-woven polypropylene fibers.

16. The cigarette of claims 11 or 12 wherein the filter element includes first and second longitudinally disposed filter segments; the first segment including a filter material in intimate contact with basic material being disposed adjacent the smokable rod, the second segment including a filter material being disposed adjacent the first segment.

17. The cigarette of claim 16 wherein the filter material of the second segment includes non-woven cellulose acetate.

18. The cigarette of claim 16 wherein the filter material of the first segment comprises non-woven polyester fibers.

19. The cigarette of claim 16 wherein the filter material of the first segment comprises non-woven polypropylene fibers.

20. A smoking article comprising a filter element which includes a non-woven thermoplastic filter material in intimate contact with a basic material having a $pK_b$ at 25° C. of less than about 3.

21. The smoking article of claim 20 wherein the filter element further includes a non-woven thermoplastic filter material in intimate contact with a basic material having a $pK_b$ at 25° C. of less than about 2.

22. A smoking article comprising a filter element which includes a non-woven thermoplastic filter material in intimate contact with an acidic material having a $pK_a$ at 25° C. of less than about 3.

23. The smoking article of claim 22 wherein the filter element further includes a non-woven thermoplastic filter material in intimate contact with an acidic material having a $pK_a$ at 25° C. of less than about 2.

24. The cigarette of claims 1, 2, 3 or 7 wherein the non-woven filter material consists essentially of polyester fibers and lubricant.

25. The cigarette of claims 1, 2 or 7 wherein the acidic material is an inorganic acid.

26. The cigarette of claims 1, 2 or 7, wherein the filter material in intimate contact with the acidic material comprises more than about 1.0 percent acidic material, based on the weight of the filter material.

27. The cigarette of claims 11, 12 or 16 wherein the filter material in intimate contact with the basic material comprises more than about 1.0 percent basic material, based on the weight of the filter material.

28. The cigarette of claims 11, 12 or 16 wherein the basic material is an inorganic base.

29. The cigarette of claims 11, 12 or 16 wherein the non-woven filter material consists essentially of polyester fibers and lubricant.

30. The smoking article of claim 20 wherein the non-woven filter material consists essentially of polypropylene fibers.

31. The smoking article of claim 20 wherein the basic material is an inorganic base.

32. The smoking article of claim 20 wherein the non-woven filter material consists essentially of polyester fibers.

33. The smoking article of claim 20 wherein the non-woven filter material consists essentially of polyester fibers and lubricant.

34. The smoking article of claim 22 wherein the non-woven filter material consists essentially of polypropylene fibers.

35. The smoking article of claim 22 wherein the acid material is an inorganic acid.

36. The smoking article of claim 22 wherein the non-woven filter material consists essentially of polyester fibers and lubricant.

* * * * *